United States Patent [19]

Brandt, Sr.

[11] Patent Number: 5,067,276

[45] Date of Patent: Nov. 26, 1991

[54] SEMI-AUTOMATIC GATE

[76] Inventor: Kenneth R. Brandt, Sr., 1022 Avenue D, Billings, Mont. 59102

[21] Appl. No.: 657,413

[22] Filed: Feb. 19, 1991

[51] Int. Cl.[5] ..... E05F 11/00; E06B 11/00

[52] U.S. Cl. ..... 49/331; 49/30; 49/273; 49/339; 49/347; 49/357; 49/385

[58] Field of Search ..... 49/331, 332, 327, 339, 49/347, 357, 385, 387, 30, 273

[56] References Cited

U.S. PATENT DOCUMENTS

| | | | |
|---|---|---|---|
| 433,565 | 8/1890 | Harrington | 49/385 X |
| 885,085 | 4/1908 | Russell et al. | 49/331 |
| 1,118,415 | 11/1914 | Hancock | 49/331 |
| 1,910,220 | 5/1933 | Kremser et al. | 49/331 |
| 2,563,894 | 8/1951 | White | 49/331 X |

*Primary Examiner*—Philip C. Kannan
*Attorney, Agent, or Firm*—Leon Gilden

[57] ABSTRACT

A semi-automatic gate may be opened from a vehicle by pulling on a line attached to a counterbalance control mechanism. The counterbalance control mechanism comprises a cylinder having a damper-controlled flow of water arrangement which allows an enclosed quantity of water to shift when the gate is opened and to then slowly return past the damper to effect a subsequent gate closing. Water is also used within the gate support structure to provide an additional shifting of weight when the gate is opened or closed.

5 Claims, 5 Drawing Sheets

48
52
10
50
54
6
16
9
8
104
82
II III
14
102
9
8
16
100
II III
12

14
5

100
26
24
40
82
38
34
44
10
22
28
7
16
56
36
92
32
42
3
46
12
18
30
20

SEMI-AUTOMATIC GATE

BACKGROUND OF THE INVENTION

1. Field of the Invention

The present invention relates to closing mechanisms for gates and more particularly pertains to a new and improved gate control mechanism which utilizes the shifting of water to effect weight-controlled movement of a gate between open and closed positions.

2. Description of the Prior Art

The use of gate opening and closing assist mechanisms is well known in the prior art. More specifically, gate structures which are pivotal into an open or closed position have quite frequently been constructed with the use of counterbalance weights to ease the effort required when either lifting or closing the associated gate. As can be appreciated, the use of counterbalance weights allows a gate to be substantially balanced, most likely in a closed position, and through a minimal lifting force supplied by an individual, this balance can be altered to allow the gate to be moved into an open position.

While this type of gate construction is quite useful when opening a gate, it can be understood that normally a substantially larger force is required to pull the gate back into a closed position. Further, there are no known gate constructions which use the shifting of counterbalance weights to effect an automatic closing of the gate after an opening the gate thereof. Accordingly, the present invention substantially departs from the conventional concepts and designs of the prior art and in so doing, provides for a counterbalance mechanism which allows for a gate to be opened with minimal effort while at the same time, the gate will close automatically upon a relinquishment of effort by the individual.

Therefore, it can be appreciated that there exists a continuing need for this type of new and improved semi-automatic gate opening and closing mechanism and as such, the present invention provides for this long recognized need.

SUMMARY OF THE INVENTION

In view of the foregoing disadvantages inherent in the known types of gate opening mechanisms now present in the prior art, the present invention provides an improved gate opening construction wherein the same can be utilized to open a gate through a minimal effort and then close the gate automatically upon a cessation of such effort. As such, the general purpose of the present invention, which will be described subsequently in greater detail, is to provide a new and improved gate opening mechanism which has all the advantages of the prior art gate opening mechanisms and none of the disadvantages.

To attain this, the present invention provides for a semi-automatic gate which may be opened from a vehicle by pulling on a line attached to a counterbalance control mechanism. The counterbalance control mechanism comprises a cylinder having a damper-controlled flow of water arrangement which allows the water to shift when the gate is opened and to then slowly return past the damper to effect a gate closing. Water is also used within the gate support structure to provide additional weight shifting when the gate is opened or closed.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out it various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved gate opening mechanism which has all the advantages of the prior art gate opening mechanisms and none of the disadvantages.

It is another object of the present invention to provide a new and improved gate opening mechanism which may be easily and efficiently manufactured and marketed.

It is a further object of the present invention to provide a new and improved gate opening mechanism which is of a durable and reliable construction.

An even further object of the present invention is to provide a new and improved gate opening mechanism which is susceptible of a low cost of manufacture with regard to both materials and labor, and which accordingly is then susceptible of low prices of sale to the consuming public, thereby making such gate opening mechanisms economically available to the buying public.

Still yet another object of the present invention is to provide a new and improved gate opening mechanism which provides in the apparatuses and methods of the prior art some of the advantages thereof, while simultaneously overcoming some of the disadvantages normally associated therewith.

Still another object of the present invention is to provide a new and improved gate opening mechanism which utilizes a counterbalance weight structure to effect an opening of a gate by minimal effort an automatic closing of such gate upon a cessation of such effort.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
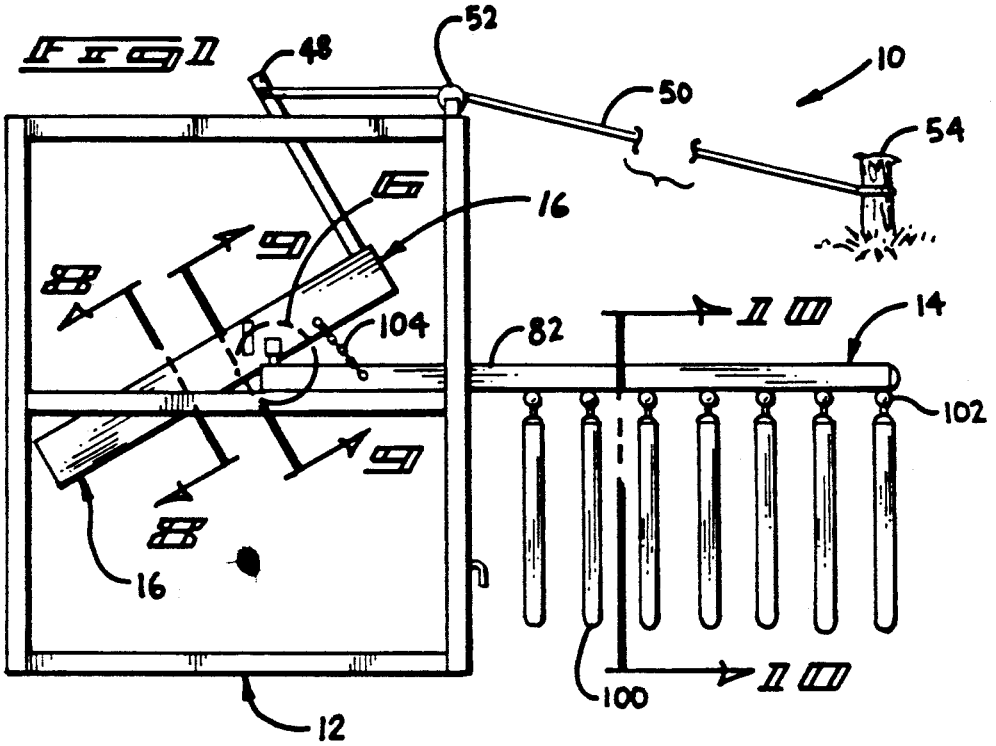
FIG. 1 is a side elevation view of the gate opening mechanism comprising the present invention.
Figure 2:
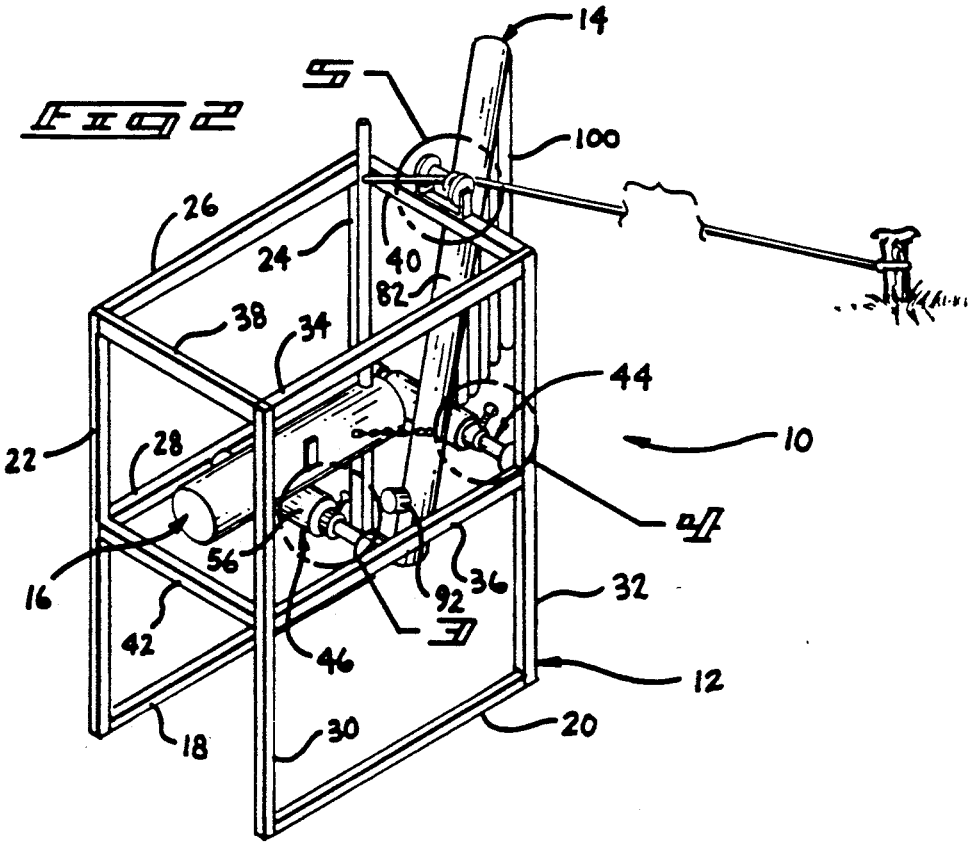
FIG. 2 is an isometric view of the gate opening mechanism.

With reference now to the drawings, and in particular to FIGS. 1 and 2 thereof, a new and improved semi-automatic gate opening mechanism embodying the principles and concepts of the present invention and generally designated by the reference numeral 10 will be described.

More specifically, it will be noted that the gate mechanism 10 includes a frame structure 12 to which a gate 14 is pivotally attached. Further illustrated is a balance cylinder or pipe 16 which is also pivotally attached to the frame support structure 12.

With further reference to the frame support structure 12, it will be seen that the same comprises a pair of paralleledly aligned ground contacting support bars 18, 20 which support the weight of the entire assembly 10. The ground support bar 18 has a pair of upstanding support members 22, 24 attached to respective ends thereof with these upstanding members having their remaining free ends attached together by a further support member 26. An intermediate support bar 28 is attached between the members 22, 24 and is paralleledly aligned with the supports 18, 26.

Similarly, the support bar 20 has a pair of vertical upstanding support members 30, 32 attached to opposed ends thereof with the remaining free ends of these support members being connected together by a support member 34. An intermediate member 36 is also connected between the members 30, 32 with this intermediate member being in parallel alignment with the support bars 20, 34.

Additionally, a top support bar 38 is connected between the support members 22, 30 at a topmost portion thereof, and a similar top support bar 40 is connected between the members 24, 32 at a topmost portion thereof. An intermediate support bar 42 is connected between the members 22, 30 with this intermediate member being is parallel alignment with the support member 38.

The frame structure 12 further includes a bearing support structure 44 interconnected between the members 24, 32 with this member serving as a pivotal support for the gate assembly 14. Similarly, a bearing support structure 46 is interconnected between the members 28, 36 at an intermediate position thereof, and this bearing support member serves as a pivotal support connection for the balance cylinder 16.

With particular reference to FIGS. 1, 2, 3 and 5 of the drawings, a more complete description of the balance cylinder 16 will be provided. As shown, the balance cylinder 16 essentially consists of a closed cylinder wherein, in a typical preferred embodiment, five gallons of water is permanently retained. Fixedly secured to a topmost portion of the cylinder 16 is a actuation lever 48. The actuation lever 48 is preferably of a rigid, strong construction and is inclined forwardly at approximately ten degrees relative to the longitudinal axis of the cylinder 16. Attached to the free end of the lever 48 is a flexible cord 50 positionable over a guide pulley 52 and having its remaining free end attached to a support post 54 remotely located from the gate assembly 10.

As further illustrated in FIGS. 1, 2, 3 and 3*a*, the balance cylinder 16 is fixedly secured (preferably by welding) to a rotatable bearing sleeve 56. The cylindrically shaped sleeve 56 is slidably, rotatably positioned over a tubular member 58 which is telescopingly positioned over a rod 60. The members 58, 60 comprise the bearing support structure 46 as aforementioned. As clearly illustrated in FIG. 3, a thumb screw 62 can be utilized in a known manner to allow adjustable telescoping movement between members 58, 60 to thus aid in the assembly and disassembly of the entire gate control structure 10.

Figure 3:
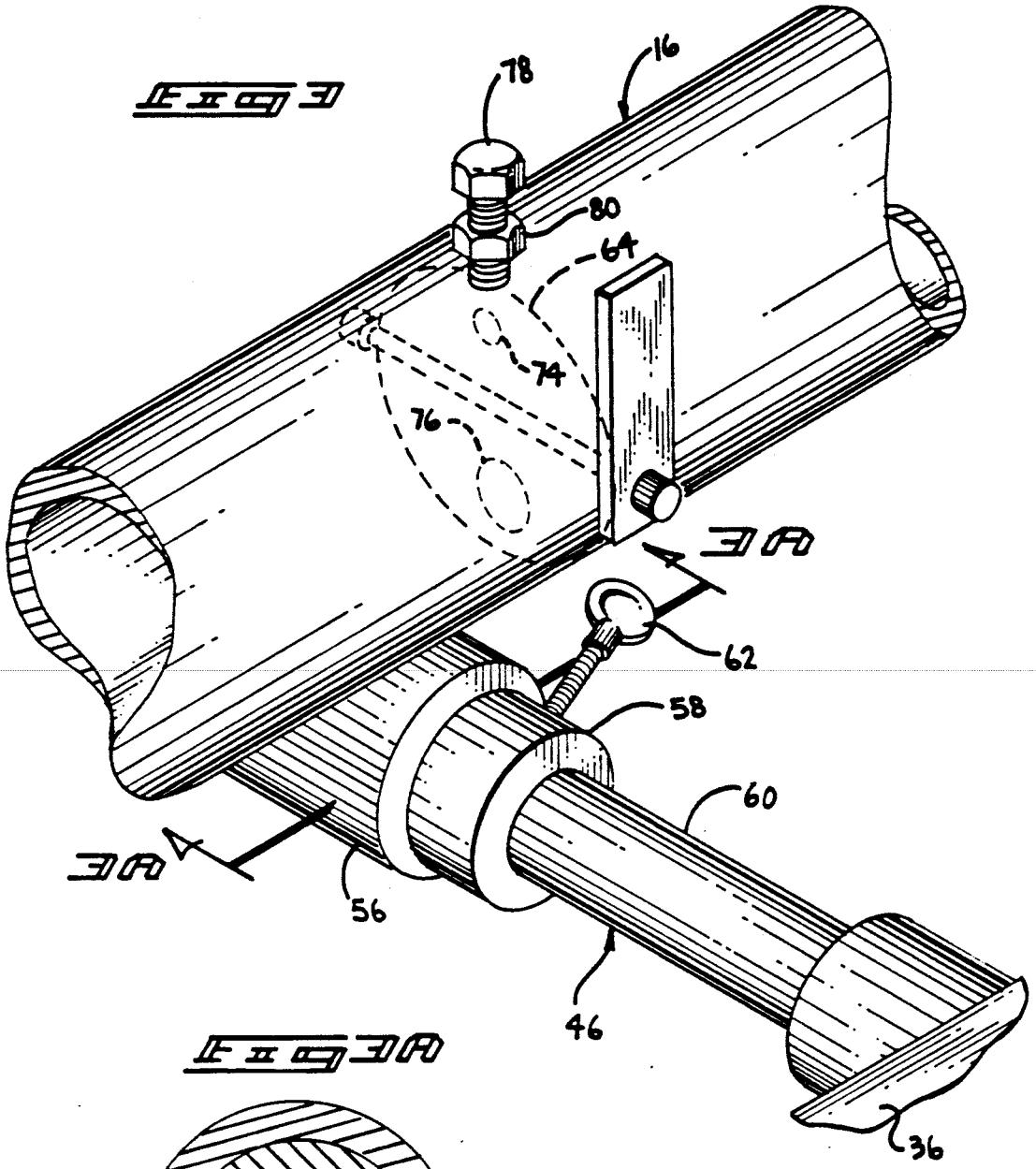
FIG. 3 is a detail view of the balance pipe forming a part of the invention.
Figure 3A:
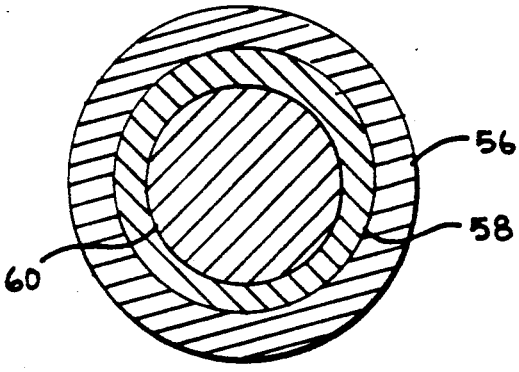
FIG. 3*a* is a cross-sectional view as viewed along the line 3*a*—3*a* shown in FIG. 3.
Figure 4:
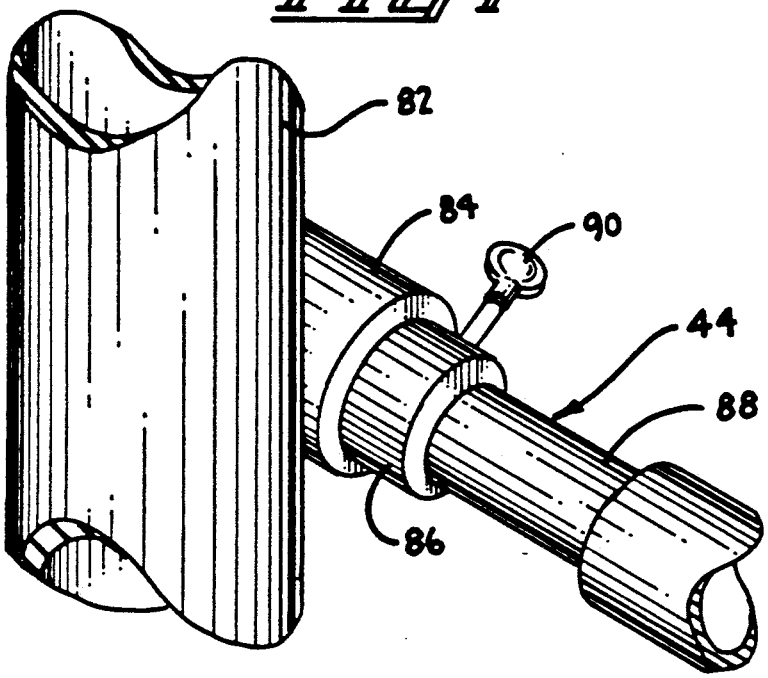
FIG. 4 is a detail view of a support arm forming a part of the present invention.
Figure 5:
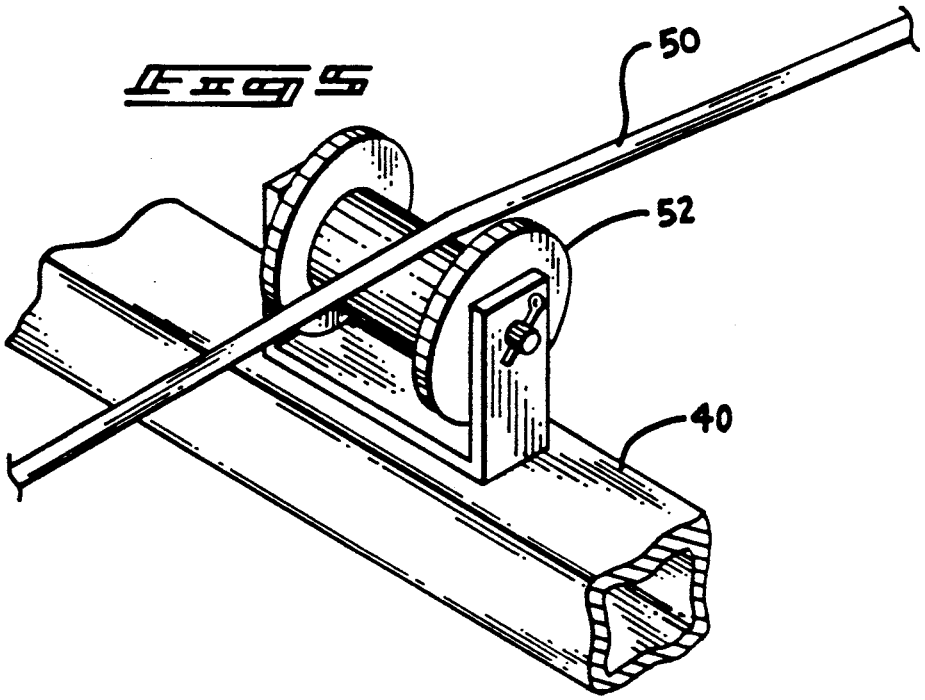
FIG. 5 is a detail view of a guide pulley associated with the present invention.
Figure 9:
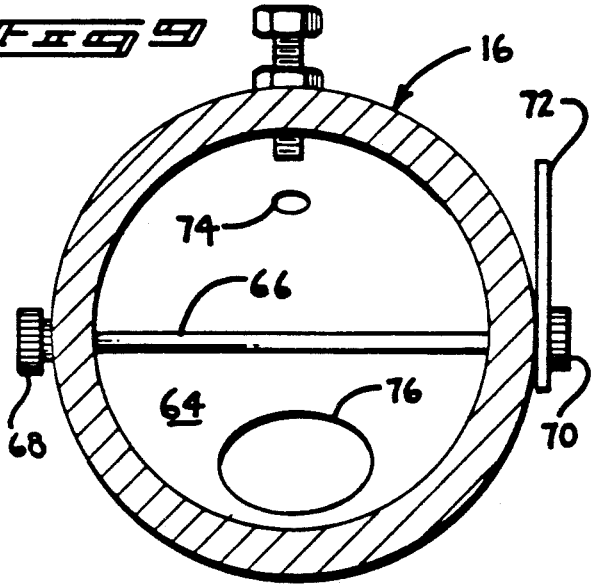
FIG. 9 is a cross-sectional view as viewed along the line 9—9 in FIG. 1.
Figure 10:
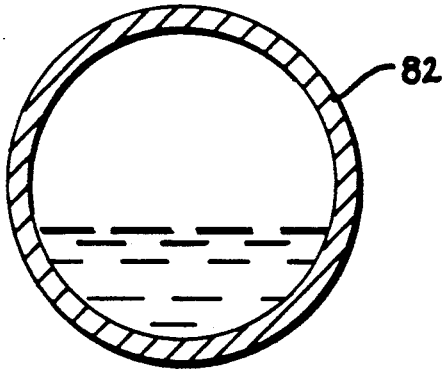
FIG. 10 a cross-sectional view as viewed along the line 10—10 in FIG. 1.

With concurrent reference to FIG. 3 and FIG. 9 of the drawings, it will be noted that the balance cylinder 16 further includes a pivotally moveable water flow control damper 64. The damper 64 is fixedly secured to a rotatable shaft 66 which is pivotally attached to an interior portion of the balance cylinder 16. More particularly, the shaft 66 has its opposed ends extending through the opposite sidewalls of the balance cylinder 16 and conventional bearing end caps 68, 70 rotatably support the shaft 66 in a known manner. Additionally, a counterbalance damper control member 72 is adjustably attached to the shaft 66 in a conventional manner.

The damper 64, as best illustrated in FIG. 9, includes an air bleed aperture 74 in a topmost portion thereof and a water flow orifice 76 positioned near a bottom portion thereof. Additionally, a damper positioning set screw 78 extends through a topmost sidewall of the balance cylinder 16, as shown in both FIGS. 3 and 9, and includes a lock nut 80 which controls the depth of penetration of the set screw into the balance cylinder 16. The set screw 78 is utilized to regulate the amount of pivotably movement of the damper 64 for a purpose which will be subsequently described in greater detail.

With respect to the structure of the gate assembly 14, reference is made to FIGS. 1, 2, 4 and 10 of the drawings. In this regard, the gate assembly 14 is seen to comprise a closed tubular member 82 which, in a preferred typical embodiment, contains two and one half gallons of water. The tubular member 82 is fixedly secured to a further sleeve 84 positioned over the bearing support structure 44 in a manner similar to the securement of the rotatable sleeve 56 on the bering support structure 46 as aforedescribed. In this connection, the sleeve 84 is rotatably supported over a tubular member 86 which telescopingly receives a further tubular member 88 and a set screw 90 is utilizable to adjustably lengthen or shorten the bearing support structure 44 in a now apparent manner. As in the case of the bearing support structure 46, this adjustable positional movement of the members 86, 88 relative to each other allows for ease of assembly and disassembly of the bearing support structure 44.

Figure 6:
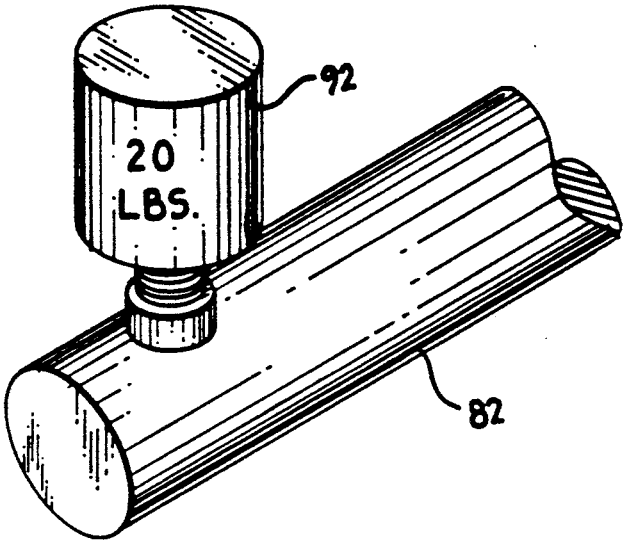
FIG. 6 is a detail view of a balance weight associated with the present invention.
Figure 7:
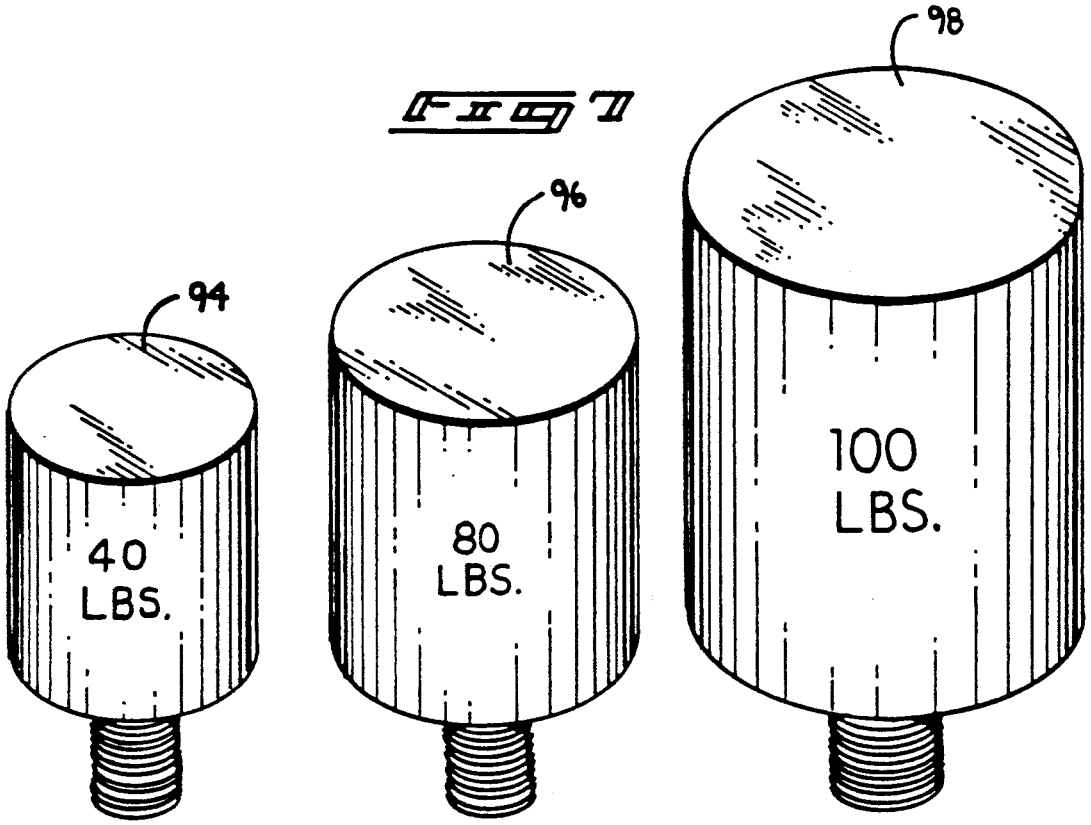
FIG. 7 illustrates a plurality of differently sized balance weights which can be used with the present invention.

While the water contained within the member 82 facilitates a shifting of weight of the gate member 14 about the bearing support structure 44, a further balancing effect is achieved through the use of a removable weight 92 as best illustrated in FIG. 6. FIG. 7 of the drawings illustrates three further differently sized weights 94, 96, 98 which can be utilized to vary the degree of balance of the gate assembly 14. The weights 94, 96, 98 are illustrative only in nature and are intended to illustrate the adjustable movement feature of the gate 14.

The gate assembly 14 further includes a plurality of downwardly hanging, flexibly attached rods 100. Each of these rods 100 are of a rigid structure and are attached by hooks or chains 102 to the gate arm 82 by any conventional means. Inasmuch as the rods 100 are swingably attached to the gate arm 82, they move into a collapsed stored position when the gate arm is moved upwardly as best illustrated in FIG. 2. An additional important feature of the present invention 10 is the fact that the balance cylinder 16 and the gate 14 are interconnected by a flexible chain 104 whereby movement of one also effects movement of the other.

Figure 8:
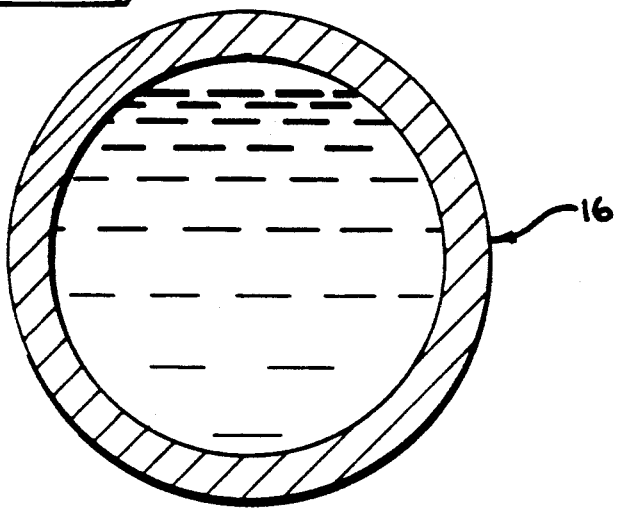
FIG. 8 is a cross-sectional view as viewed along the line 8—8 in FIG. 1.

As to the manner of usage and operation of the present invention, initial reference is made to FIG. 1 of the drawings wherein the gate 14 is shown in a down or closed position. In a typical situation, the gate 14 might be blocking a roadway while the flexible cord 50 could extend beside or across the roadway so as to facilitate a grasping thereof by an individual within a vehicle. When the flexible member 50 is pulled, the actuating lever 48 operates to pivotally move the balance cylinder 16 forwardly towards the gate 14. As shown in FIG. 8, a bottom section of the balance cylinder 16 is filled with the aforementioned supply of water, and this water rushes forwardly towards the end of the balance cylinder on which the actuation lever 48 is attached. This forward movement of the water effects a shifting of weight within the balance cylinder 16 while at the same time, the counterbalance 72 operates to open the damper 64 so as to allow unimpeded flow of the water within the cylinder 16.

At the same time the balance cylinder 16 moves forwardly about the bearing support structure 46, the chain 104 operates to pull downwardly on the gate arm 82 which allows the water stored within the gate arm to move towards the end of the arm having the weight 92 attached thereto. This shifting of the water weight causes the gate arm 82 to move upwardly as shown in FIG. 2, and the gate rods 100 swing into their stored compact position.

Once the vehicle has passed the gate 14 and the flexible member 50 has been released, the balance cylinder 16 will gravitate back towards its resting position as shown in FIG. 1. This is due to the fact that the balance cylinder 16 is off center on the bearing support structure 46 whereby the end thereof not having the actuation lever 48 attached thereto is of a greater weight. This additional weight causes the balance cylinder 16 to move downwardly into the position shown in FIG. 1; however, the weight of the gate arm 82 prevents this movement until the water in the balance cylinder shifts back towards its original position when the gate is down.

The movement of the gate 14 into the downward position is automatic and can be timed to occur at a desired rate by the use of the aforedescribed damper 64. In this respect, the shifting water must flow through the aperture 76 formed in the damper 64, whereby the weight shift is gradual to thus prevent a rapid downward closing of the gate 14. The set screw 78 can be utilized to prevent the damper 64 from going into a completely closed position so that additional water may flow past the damper at an increased flow rate, as well as through the orifice 76, to effect an even faster gate closing.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved semi-automatic gate comprising, frame support means;

gate means for selectively blocking a roadway and being pivotally attached to said frame support means;

balance means mounted to the frame means and the gate means for effecting a pivotal movement of said gate means;

manual control means for controlling said balance means, thereby to effect said pivotal movement of said gate means;

said balance means comprises a closed container pivotally attached to said frame support means, said closed container having a supply of selectively shiftable fluid container therein, said manual control means being operable to effect a pivotal movement of said closed container to thereby shift said fluid within said container, thus to effect said pivotal movement of said gate means, and wherein said gate means includes a closed compartment having a second fluid supply contained therein, said second fluid supply being shiftable within said closed compartment to further assist said pivotal movement of said gate means.

2. A new and improved semi-automatic gate as described in claim 1 wherein a pivotal movement of said balance means is accompanied by a shift of said fluid contained in said closed container forming a part of said balance means and also by a concurrent shifting of said second fluid supply contained in said closed compartment forming a part of said gate means.

3. A new and improved semi-automatic gate as described in claim 2, wherein said closed container and said closed compartment are interconnected by a flexible chain member.

4. A new and improved semi-automatic gate as described in claim 2, and further including fluid flow regulating means positioned within said closed container, said fluid flow regulating means controlling a rate of fluid flow within said balance means so as to control a rate of said pivotal movement of said gate means.

5. A new and improved semi-automatic gate as described in claim 4, wherein said fluid flow regulating means comprises a selectively positionable, pivotally moveable damper.

* * * * *